US008535408B2

(12) United States Patent
Sue et al.

(10) Patent No.: US 8,535,408 B2
(45) Date of Patent: Sep. 17, 2013

(54) HIGH THERMAL CONDUCTIVITY HARDFACING

(75) Inventors: Jiinjen Albert Sue, The Woodlands, TX (US); Harold Sreshta, Conroe, TX (US); Rajagopala Pillai, Pasadena, TX (US)

(73) Assignee: Reedhycalog, L.P., Houston, TX (US)

( * ) Notice: Subject to any disclaimer, the term of this patent is extended or adjusted under 35 U.S.C. 154(b) by 0 days.

(21) Appl. No.: 13/357,244

(22) Filed: Jan. 24, 2012

(65) Prior Publication Data

US 2013/0020136 A1 Jan. 24, 2013

Related U.S. Application Data

(63) Continuation-in-part of application No. 12/432,179, filed on Apr. 29, 2009, now abandoned.

(51) Int. Cl.

| | |
|---|---|
| ***C22C 1/05*** | (2006.01) |
| ***C04B 35/56*** | (2006.01) |
| ***C23C 4/06*** | (2006.01) |
| ***E21B 10/36*** | (2006.01) |

(52) U.S. Cl.

USPC ..... 75/252; 175/374; 175/425; 427/451; 501/87

(58) Field of Classification Search

None

See application file for complete search history.

(56) References Cited

U.S. PATENT DOCUMENTS

| | | | |
|---|---|---|---|
| 3,341,337 | A | 9/1967 | Quaas et al. |
| 3,523,569 | A | 8/1970 | Quaas |
| 4,075,376 | A | 2/1978 | Jaeger |
| 4,173,685 | A | 11/1979 | Weatherly |
| 4,228,214 | A | 10/1980 | Steigelman et al. |
| 4,610,931 | A | 9/1986 | Nemeth et al. |
| 4,787,736 | A | 11/1988 | Mori et al. |
| 4,923,511 | A | 5/1990 | Krizan et al. |
| 5,658,678 | A | 8/1997 | Stoll et al. |
| 5,763,658 | A | 6/1998 | Beihoffer et al. |
| 5,880,382 | A | 3/1999 | Fang et al. |
| 5,935,350 | A | 8/1999 | Raghu et al. |
| 5,968,603 | A | 10/1999 | Urbanek et al. |
| 6,045,750 | A | 4/2000 | Drake et al. |
| 6,124,564 | A | 9/2000 | Sue et al. |
| 6,197,084 | B1 | 3/2001 | Liang |
| 6,521,353 | B1 | 2/2003 | Majaji et al. |
| 6,524,366 | B1 | 2/2003 | Seegopaul et al. |
| 6,613,452 | B2 | 9/2003 | Weir |
| 6,655,478 | B2 | 12/2003 | Liang et al. |
| 6,655,882 | B2 | 12/2003 | Heinrich et al. |
| 6,659,206 | B2 | 12/2003 | Liang et al. |
| 6,782,958 | B2 | 8/2004 | Liang et al. |
| 6,869,460 | B1 | 3/2005 | Bennett et al. |
| 6,888,088 | B2 | 5/2005 | Bolton et al. |
| 6,903,302 | B2 | 6/2005 | Kim et al. |
| 6,946,096 | B2 | 9/2005 | Giesler et al. |
| 7,017,677 | B2 | 3/2006 | Keshavan et al. |
| 7,036,614 | B2 | 5/2006 | Liang et al. |
| 7,048,080 | B2 | 5/2006 | Griffo et al. |
| 7,128,773 | B2 | 10/2006 | Liang et al. |
| 7,235,211 | B2 | 6/2007 | Griffo et al. |
| 7,237,628 | B2 | 7/2007 | Desai et al. |
| 7,258,177 | B2 | 8/2007 | Liang et al. |
| 7,361,411 | B2 | 4/2008 | Daemen et al. |
| 7,373,997 | B2 | 5/2008 | Kembaiyan et al. |
| 7,407,525 | B2 | 8/2008 | Liang |
| 7,475,743 | B2 | 1/2009 | Liang et al. |
| 7,621,347 | B2 | 11/2009 | Overstreet |
| 2004/0157066 | A1 | 8/2004 | Arzoumanidis |
| 2006/0185773 | A1 | 8/2006 | Chiovelli |
| 2006/0207803 | A1 | 9/2006 | Overstreet |
| 2007/0056777 | A1 | 3/2007 | Overstreet |
| 2007/0095577 | A1 | 5/2007 | Griffo et al. |
| 2008/0226843 | A1 | 9/2008 | Fukubayashi et al. |
| 2008/0251297 | A1 | 10/2008 | Overstreet et al. |
| 2010/0276208 | A1 | 11/2010 | Sue |
| 2010/0288559 | A1 | 11/2010 | Dezert et al. |

FOREIGN PATENT DOCUMENTS

| | | | |
|---|---|---|---|
| GB | 2109417 | A | 6/1983 |
| GB | 2232108 | A | 12/1990 |
| GB | 2334912 | A | 9/1999 |
| GB | 2470459 | A | 11/2010 |
| WO | 2006/099629 | A1 | 9/2006 |
| WO | 2006099629 | A1 | 9/2006 |
| WO | 2008/112272 | A1 | 9/2008 |

OTHER PUBLICATIONS

PCT/US2013/022925 International Search Report and Written Opinion dated Jun. 4, 2013 (9 p.).

Sep. 17, 2010 Combined Search and Examination Report for Patent Application No. GB1007983.7.

Jun. 24, 2011 Response to Sep. 17, 2010 Combined Search and Examination Report for Patent Application No. GB1007983.7.

Sep. 27, 2011 Office Action for Patent Application CA 2,702,658.

Mar. 20, 2012 Response to Sep. 27, 2011 Office Action for Patent Application CA 2,702,658.

G.V. Samsonov et al.; "Handbook of Refractory Compounds"; Translated from Russian by Kenneth Shaw; IFI Data Base Library; IFI/PLENUM, Data Company, 1980, p. 193.

*Primary Examiner* — Roy King

*Assistant Examiner* — Ngoclan T Mai

(74) *Attorney, Agent, or Firm* — Conley Rose, P.C.

(57) ABSTRACT

A hardmetal composition comprises tungsten carbide in an amount greater than 50 weight percent of the hardmetal composition. In addition, the hardmetal composition comprises a binder material consisting of at least 90 weight percent nickel, a binder flux between 3.5 to 10.0 weight percent chosen from the group consisting of boron and silicon, and less than 1.0 weight percent other components.

24 Claims, 11 Drawing Sheets

Microstructures of Invention Samples Deposited via Various Thermal Spray Techniques

Laser Cladding

Plasma Transferred Arc

Flame Spray

Microstructures of Comparative Hardmetals

Comparative Hardfacing Sample E

Comparative Hardfacing Sample D

HIGH THERMAL CONDUCTIVITY HARDFACING

CROSS-REFERENCE TO RELATED APPLICATIONS

This application is a continuation in part of U.S. application Ser. No. 12/432,179, filed Apr. 29, 2009, now abandoned, and entitled "High Thermal Conductivity Hardfacing for Drilling Applications," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to hardfacing to enhance resistance to erosion, abrasive wear, and frictional wear. More particularly, the invention relates to high thermally conductive hardfacing for use with drilling equipment and bearings.

2. Background of the Technology

Oil and gas wells can be formed by rotary drilling processes that involve a drill bit connected onto the lower end of a drill string. The drill bit is rotated downhole by rotating the drill string at the surface, actuation of downhole motors or turbines, or both. With weight applied to the drill string, the rotating drill bit engages the earthen formation and proceeds to form a borehole along a predetermined path toward a target zone.

While the bit is rotated, drilling fluid is pumped through the drill string and directed out of the face of the drill bit. The drilling fluid, also referred to as mud, performs several important functions. In particular, the fluid removes formation cuttings from the bit's cutting structure, removes cut formation materials from the bottom of the hole, and removes heat caused by contact between the bit and the formation. The drilling fluid and cuttings removed from the bit face and from the bottom of the hole are forced from the bottom of the borehole to the surface through the annulus between the drill string and the borehole sidewall.

One basic type of drill bit in general use for drilling a wellbore are rotary cone bits, which can also be referred to as rolling cutter bits, milled tooth bits, or rock bits. These generally use one or more rolling cones containing projections called cutting teeth. The cones are rotatably mounted on a drill bit body such that when the drill bit body is rotated and weight is applied, the teeth engage the formation being drilled and the cones rotate, imparting a boring action that forms the wellbore.

Another basic type of drill bit in general use is fixed cutter drill bits which can also be referred to as drag bits. A fixed cutter drill bit uses cutting elements that are attached to a drill bit body. When the fixed cutter drill bit is rotated and weight applied, the cutting elements contact the formation being drilled in a shearing action that breaks off pieces of the formation and forms the wellbore.

Certain surfaces of both rock bits and drag bits as well as other drilling related tools such as reamers, V-stab and stabilizers can be subject to wear during the drilling process, such as the side surface of a bit body that is contact with the wellbore wall and surface areas between the cutting elements of a drag bit. These surfaces may include a layer of material, often referred to as hardfacing or hardmetal, that is designed to resist wear.

Conventional hardmetal materials used to provide wear resistance to the underlying substrate of the drill bit typically comprise carbides. The carbide materials are used to impart properties of wear resistance and fracture resistance to the bit. Conventional hardmetal materials useful for forming a hardfaced layer can also include one or more alloys to provide desired physical properties.

Conventional hardfacing is applied onto the underlying bit surface by known welding methods or thermal spray techniques, such as Laser Cladding, Plasma Transferred Arc or Flame Spray techniques. The associated thermal impact of these processes can cause thermal stress and cracking to develop in the hardfacing material microstructure, which may lead to premature chipping, flaking, fracturing, and ultimately failure of the hardfacing layer. In addition, the process of welding the hardmetal materials onto the underlying substrate can make it difficult to provide a hardfaced layer having a consistent coating thickness, which can negatively impact the service life of the bit.

Accordingly, there remains a need in the art for a wear and fracture resistant hardfacing and hardmetal compositions that experience reduced stress and associated cracking from thermal loading. Such compositions would be particularly well-received if they offered the potential to improve dimensional consistency and accuracy during deposition.

BRIEF SUMMARY OF THE DISCLOSURE

These and other needs in the art are addressed in one embodiment by a hardmetal composition. In an embodiment, the hardmetal composition comprises tungsten carbide in an amount greater than 50 weight percent of the hardmetal composition. In addition, the hardmetal composition comprises a binder material consisting of at least 90 weight percent nickel, a binder flux between 3.5 to 10.0 weight percent chosen from the group consisting of boron and silicon, and less than 1.0 weight percent other components.

These and other needs in the art are addressed in another embodiment by a bit for drilling a borehole in earthen formations. In an embodiment, the bit comprises a bit body. In addition, the bit comprises a hardfacing composition applied to the bit body. The hardfacing composition comprises tungsten carbide in an amount greater than 50 weight percent of the hardfacing composition. The hardfacing composition further comprises a binder material consisting of at least 90 weight percent nickel and a binder flux of between 3.5 to 10.0 weight percent chosen from the group consisting of boron and silicon. The silicon in the binder flux is 0.5 to 10 weight percent of the binder material and the boron in the binder flux is 0.5 to 14 weight percent of the binder material.

These and other needs in the art are addressed in another embodiment by a method for providing a wear resistant hardfacing composition onto an apparatus. In an embodiment, the method comprises providing a hardfacing composition consisting of tungsten carbide in an amount greater than 50 weight percent of the hardfacing composition and a binder material consisting of at least 90 weight percent nickel, a binder flux of between 3.5 to 10.0 weight percent chosen from the group consisting of boron and silicon, and less than 1.0 weight percent other components. In addition, the method comprises depositing the hardfacing composition onto one or more portions of the apparatus.

These and other needs in the art are addressed in another embodiment by a hardmetal composition. In an embodiment, the hardmetal composition comprises tungsten carbide in an amount greater than 60 weight percent of the hardmetal composition. The tungsten carbide comprises at least 50 volume percent of spherical tungsten carbide particles. In addition, the hardmetal composition comprises a binder material consisting of nickel and a binder flux consisting of silicon and boron, wherein the silicon in the binder flux is 0.5 to 10 weight percent of the binder material and the boron in the binder flux is 0.5 to 14 weight percent of the binder material. The tungsten carbide content (wt %) in the hardmetal composition ranges from eight to eleven times the binder flux content (wt %) of the binder.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION

Figure 1:
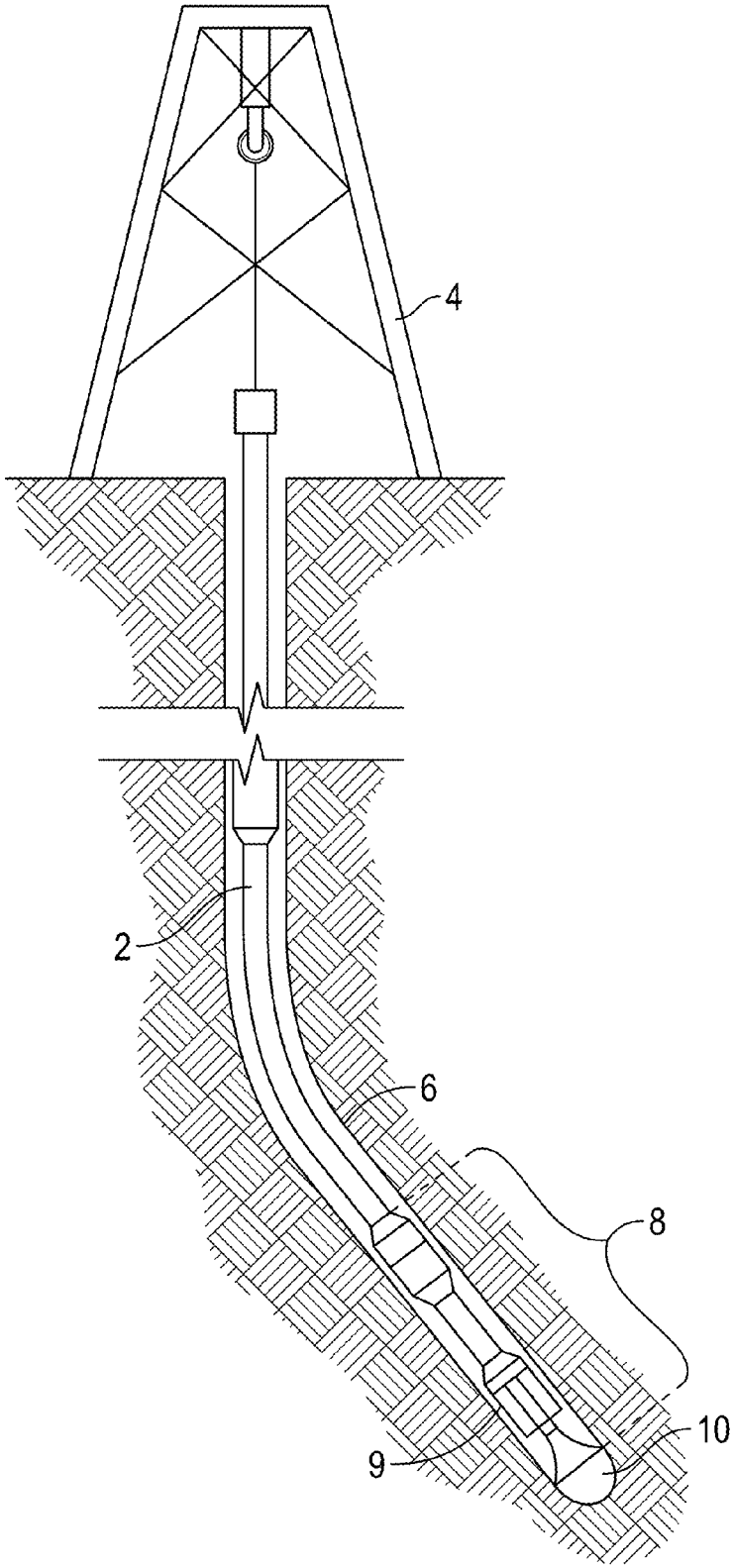
FIG. 1 is a schematic view of a downhole steerable drilling system.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Still further, as used herein, the terms "hardmetal," "hardfacing," and "hardfaced layer" refer to one or more protective layers of carbide containing material applied to an underlying substrate, such as a drill bit body, a stabilizer, a radial bearing, etc.

Referring now to FIG. 1, a drilling system for drilling a wellbore 6 into an earthen formation for the ultimate recovery of hydrocarbons is shown. The drilling system includes a drill string 2 suspended by a derrick 4. A bottom-hole assembly (BHA) 8 is located at the bottom of the drill string 2. For directional drilling, BHA 8 includes a downhole steerable drilling system 9 and comprises a drill bit 10. With weight-on-bit (WOB) applied, drill bit 10 is rotated and cuts into the earth allowing the drill string 2 to advance, thus forming the wellbore 6. In non-directional drilling applications the BHA (e.g., BHA 8) may not include a steerable drilling system (e.g., steerable drilling system 9) and may simply comprise a drill bit, typically with one or more drill collars, and optionally other tools to improve stability.

Figure 2:
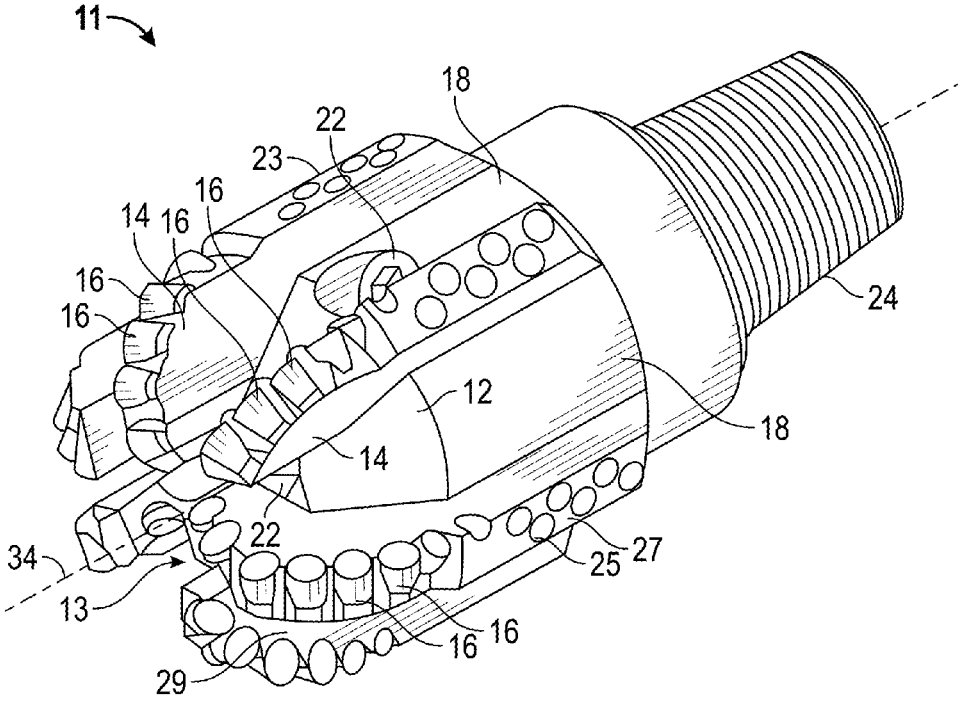
FIG. 2 is a perspective view of a drag bit including hardfacing in accordance with the principles described herein.
Figure 3:
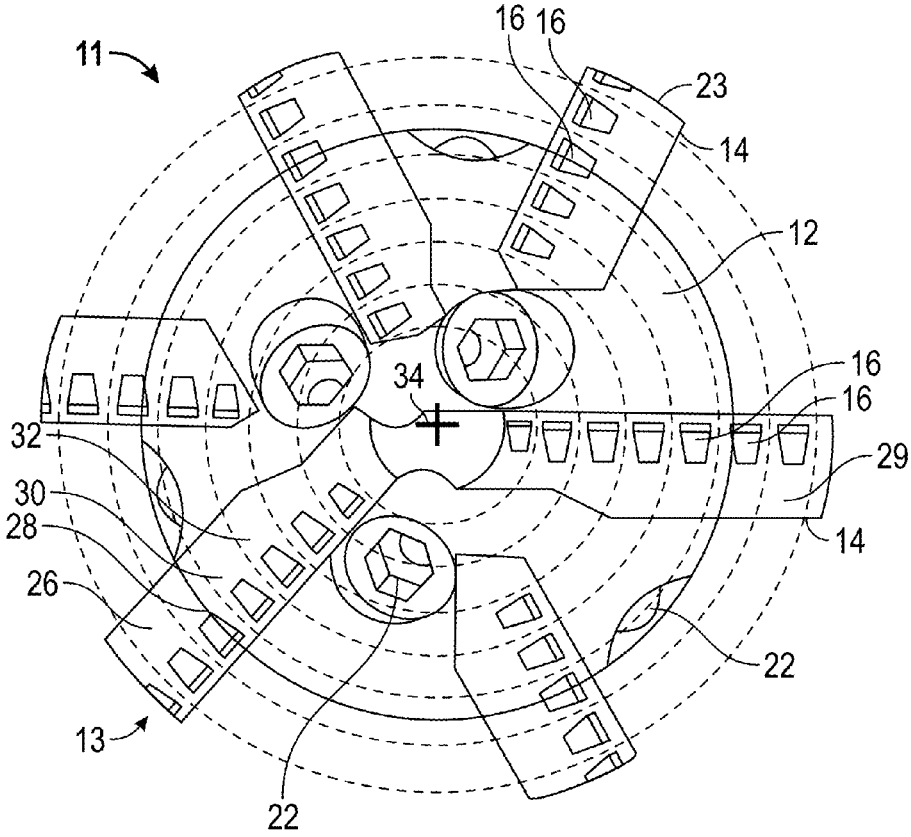
FIG. 3 is an end view of the drill bit of FIG. 2.
Figure 4:
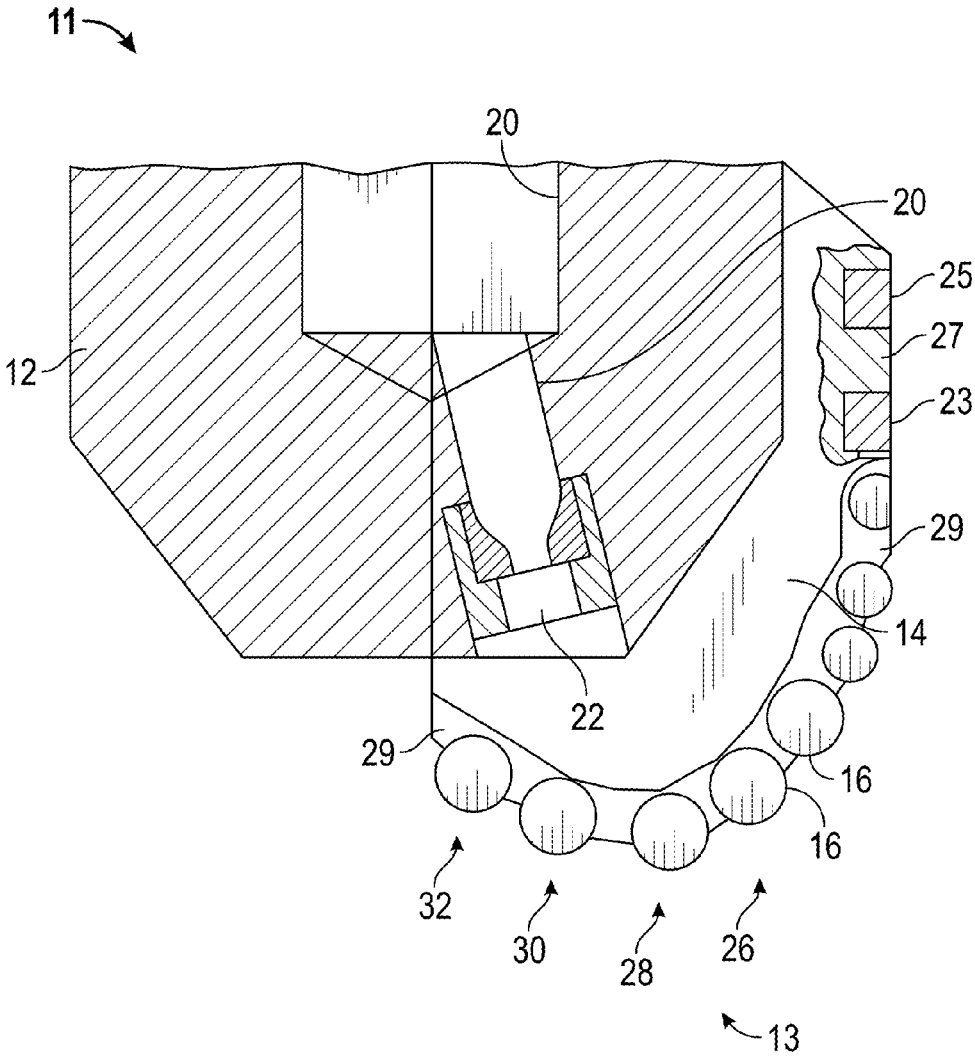
FIG. 4 is an enlarged partial cross-sectional view of the drill bit of FIG. 2 illustrating one of the blades.

Referring now to FIGS. 2-4, a rotary drag bit 11 that may be used as drill bit 10 in the drilling system of FIG. 1 is shown. Drag bit 11 has a bit body 12 made of a material such as machined steel. The bit body 12 has a leading face 13 provided with a plurality of protruding, angularly spaced blades 14. Each blade 14 carries a plurality of cutting elements 16. A channel 18 is formed between each pair of adjacent blades 14. As best shown in FIG. 4, during drilling, channels 18 are supplied with drilling fluid via a series of passages 20 provided internally of the drill bit body 12, each passage 20 terminating at a nozzle 22. The supply of drilling fluid serves to clean and cool the cutting elements 16 while in use and provide a means for circulating cuttings out of the wellbore. Bit body 12 includes a threaded shank 24 that couples drill bit 11 to the lower end of a drill string (e.g., drill string 2), thereby enabling bit 11 to be rotated about a central axis of rotation 34.

Referring still to FIGS. 2-4, blades 14 extend from the leading face 13 along the bit body 12 to form a gage contact surface 23 that defines the outer diameter of bit 11. The gage contact surface 23 includes a plurality of wear resistant inserts 25 pressed therein and hardfacing 27 surrounding the wear resistant inserts 25. During drilling, frictional engagement with the surrounding formation can abrasively wear hardfacing 27, as well as subject hardfacing 27 to increased temperatures and associated thermal stresses. Accordingly, to enhance resistance to abrasive wear and thermal stresses, hardfacing 27 preferably has a composition in accordance with the principles described in more detail below.

Cutting elements 16 may also be disposed within hardfacing 29 on blades 14, or mounted in pockets in blades 14, which are surrounded by hardfacing 29. In other words, hardfacing 29 covers some or all of blades 14 and fills some or all of the area between cutting elements 16, and thus, may be referred to as "webbing." During drilling, frictional engagement with the surrounding formation can abrasively wear hardfacing 29, as well as subject hardfacing 29 to increased temperatures and associated thermal stresses. The incipient hardfacing wear at these locations can lead to cutter damage and/or loss resulting in a catastrophic dull condition referred to as "ringout." Accordingly, to enhance resistance to abrasive wear and reduce thermal stresses, hardfacing 29 preferably has a composition in accordance with the principles described in more detail below.

FIG. 4 is a cross-sectional view of drill bit 11 showing the leading face of one blade 14, the placement of the cutting elements 16 and wear resistant inserts 25. Also shown are areas of hardfacing 27 on the gage contact surface 23 and hardfacing 29 webbing between the cutting elements 16.

As best shown in FIG. 3, cutters 16 are arranged on the blades 14 in a series of concentric rings 26, 28, 30, 32. The concentric rings 26, 28, 30, 32 are centered about axis 34. The areas between the concentric rings 26, 28, 30, 32 are areas where hardfacing 29 webbing between the cutting elements 16 is particularly susceptible to erosion and severe wear damage from tensile stresses due to thermal loading in service.

Figure 5:
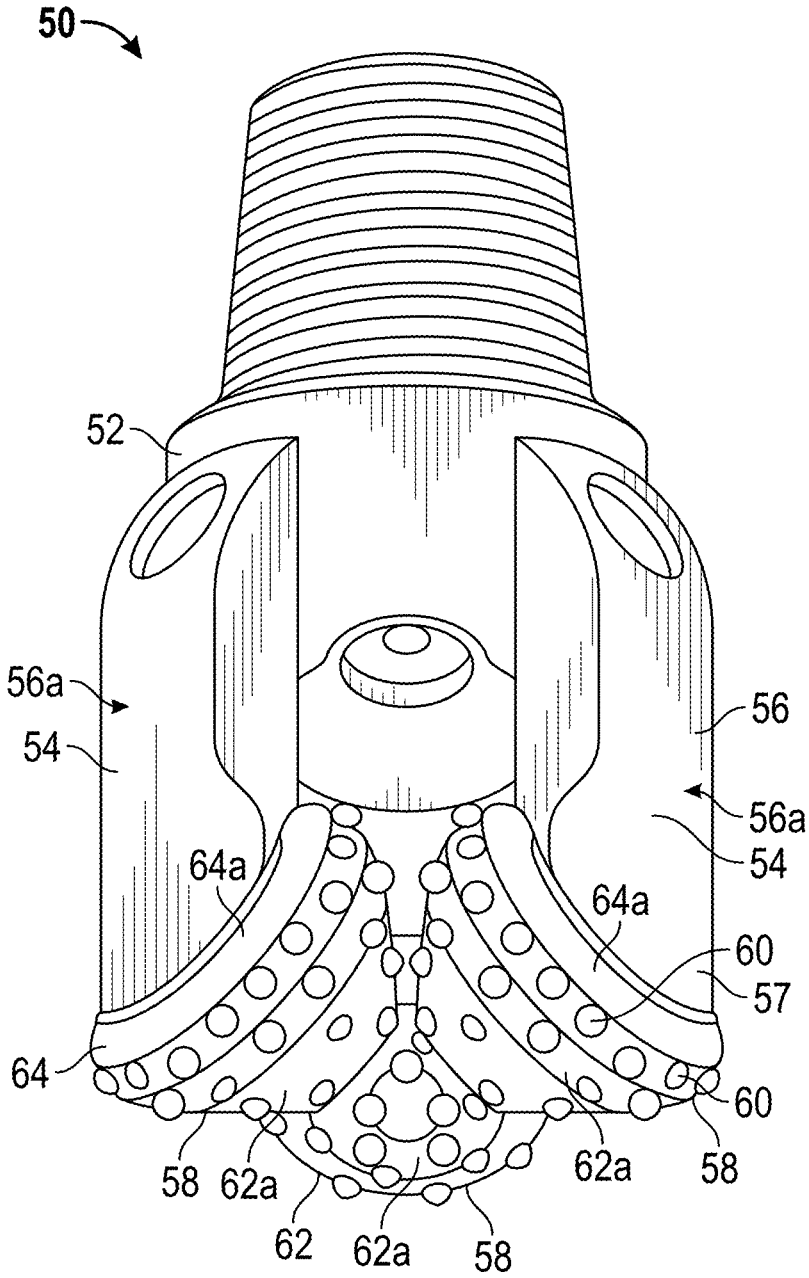
FIG. 5 is a perspective view of a rolling cone bit including hardfacing in accordance with the principles described herein.

Referring now to FIG. 5, a rolling cutter drill bit 50 that may be used as drill bit 10 in the drilling system of FIG. 1 is shown. Bit 50 includes a body 52 formed from three similar leg portions 54 (only two are shown), each leg portion 54 having an external formation facing surface 56. Each external surface 56 includes a shirttail region 57 near the bottom of the leg portion 54. The external surface 56, including the shirttail region 57, are covered with hardfacing 56*a*. A rolling cutter 58 is rotatably mounted upon each leg portion 54. Attached to the rolling cutter 58 are cutting inserts 60 which engage the earth to effect a drilling action and cause rotation of the rolling cutter 58. The exposed surface 62 of the rolling cutter 58 surrounding the cutting inserts 60 is covered with hardfacing 62*a*. The portion of the rolling cutter 58 near the leg portion 54 is often referred to as the rolling cutter gage contact surface 64, and includes hardfacing 64*a*. The rolling cutter gage contact surface 64 is a generally conical surface at the heel of a rolling cutter 58 that engages the sidewall of a wellbore as bit 50 rotates. During drilling, frictional engagement with the surrounding formation can abrasively wear hardfacing 56*a*, 62*a*, 64*a* as well as subject hardfacing 56*a*, 62*a*, 64*a* to increased temperatures and associated thermal stresses. Accordingly, to enhance resistance to abrasive wear and thermal stresses, hardfacing 56*a*, 62*a*, 64*a* preferably has a composition in accordance with the principles described in more detail below.

Although FIG. 5 and the discussion herein references a rolling cutter bit having cutting inserts, embodiments described herein are not limited to the same and include other rolling cutter bit designs such as mill tooth bits, which have teeth protruding from the cones rather than inserts. For mill tooth bits, the hardfacing can be applied on the external surface, shirttail region webbing between the teeth, as well as on the surface of the teeth themselves.

Figure 6:
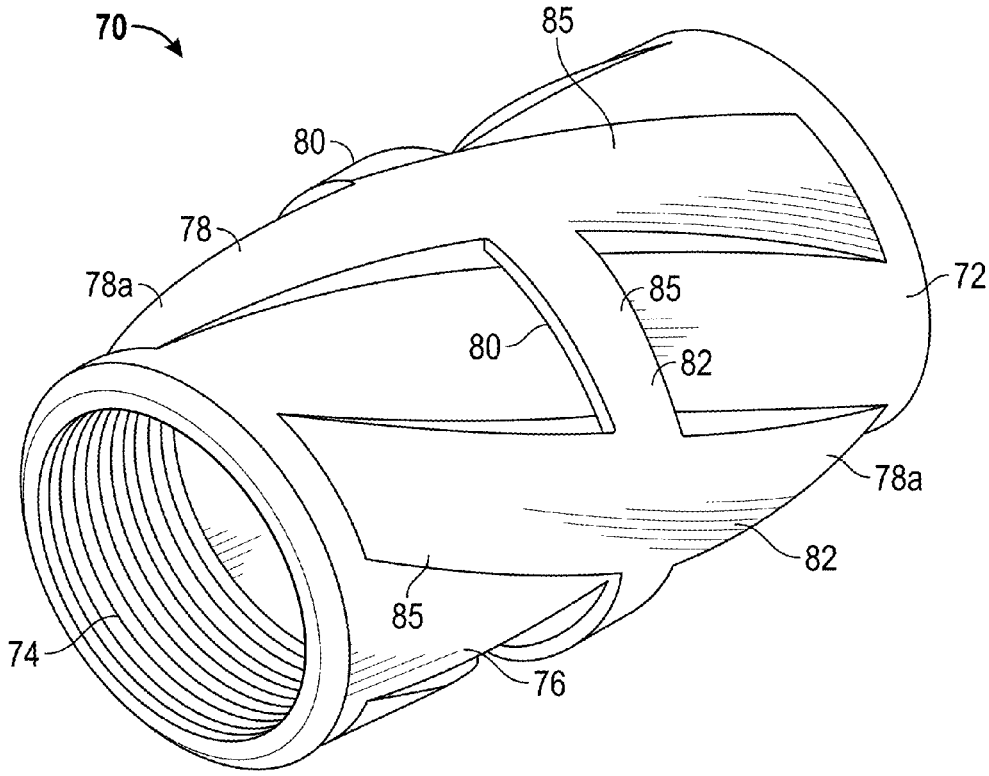
FIG. 6 is a perspective view of a stabilizer including hardfacing in accordance with the principles described herein.

Referring now to FIG. 6, a stabilizer 70 is shown comprising a generally cylindrical body 72 with a screw-threaded recesses 74 at one end configured to mate with an adjacent components of the drill string (e.g., drill string 2) or BHA (e.g., BHA 8). The radially outer wall 76 of body 72 is provided with a plurality of upstanding blades 78, each blade 78 having a substantially uniform height along its length, other than at its ends 78*a* where it tapers to the diameter of the body 72. In addition, blades 78 are substantially equally circumferentially spaced about body 72, and in this case, oriented in a generally spiral form. One or more bridging regions 80 interconnect each pair of adjacent blades 78. The surface 82 of the blades 78 and bridging regions 80 have hardfacing 85 applied, and may optionally include wear resistant inserts. During drilling, frictional engagement with the surrounding formation can abrasively wear hardfacing 85, as well as subject hardfacing 85 to increased temperatures and associated thermal stresses. Accordingly, to enhance resistance to abrasive wear and thermal stresses, hardfacing 85 preferably has a composition in accordance with the principles described in more detail below.

Embodiments of hardware (e.g., bearings), downhole tools and equipment (e.g., stabilizers, collars, etc.), drill bits (e.g., fixed cutter bits, roller cone bits, percussion bits, etc.), and devices described herein include surfaces formed from the application of engineered hardfacing that offers the potential to improve wear and fracture resistance as compared to conventional hardfacing. As will be described in more detail below, embodiments of hardfacing disclosed herein preferably (a) comprise relatively high thermal conductivity materials that reduce the potential for the introduction of detrimental thermal effects inherent with welding or thermal spray application techniques, and (b) have relatively good fluid flow properties during application to reduce the potential for dimensional inconsistencies. The hardfacing is disposed on an underlying metal or metal alloy substrate using any suitable application method including, without limitation, a thermal spray technique, such as laser cladding, plasma transferred arc welding (PTAW), flame spray, or oxyacetylene welding deposition. The applied hardfacing preferably has a surface layer thickness in the range of 0.1 to 10 mm, more preferably in the range of 0.5 to 8 mm, and still more preferably in the range of 1.0 to 5 mm. It is to be understood that the exact surface layer thickness may vary within these preferred ranges depending on the specific composition of the hardfacing, the underlying substrate, and the anticipated use of the tool or device to which the hardfacing is applied.

For drill bits, it is generally desirable to provide as much wear resistance as possible on the portions of the bit that contact the formation, as well as the portions of the bit susceptible to high erosion or other high wear conditions. The effective life of the bit is enhanced as the wear resistance of the bit is increased. As wear occurs, the drill bit may be replaced when the rate of penetration decreases to an unacceptable level. Thus, it is desirable to minimize wear so that the footage drilled by each bit is maximized. This not only decreases direct cost, but also decreases the frequency of having to "trip" a drill string to replace a worn bit with a new bit. Moreover, as gage contact surfaces of a bit wear, the diameter of the hole drilled by the bit decreases, sometimes causing drilling problems or requiring "reaming" of the hole by the next bit used. Thus, advances in drill bit wear resistance is desirable to increase the duration which a hole diameter (or gage) can be maintained, to enhance the footage a drill bit can drill before needing to be replaced, and to enhance the rate of penetration of such drill bits. Such improvements generally translate into reduction of drilling expense.

Embodiments of wear and fracture resistant hardfacing described herein have a composition comprising tungsten carbide disposed throughout a binder material. The tungsten carbide may be in the form of WC and/or $W_2C$, and provides hardness and toughness to the composition. The thermal conductivity of WC and $W_2C$ are not substantially different, and thus, the selection of tungsten carbide in the form of WC and/or $W_2C$ has a very small, if any, effect on the overall thermal conductivity of the composition. Moreover, any one or more of three different tungsten carbides can be used—Spherical Cast WC/$W_2C$, Cast and Crushed WC/$W_2C$, Macro-crystalline WC, or combinations thereof. With regard to hardness, Spherical Cast WC/$W_2C$ has a greater hardness than Cast and Crushed WC/$W_2C$, which in turn has greater hardness than Macro-crystalline WC. For toughness properties the Spherical Cast WC/$W_2C$ has greater toughness than Macro-crystalline WC, which in turn has greater toughness than Cast and Crushed WC/$W_2C$. Therefore, to optimize the hardness and toughness properties of the hardfacing composition, Spherical Cast WC/$W_2C$ is preferred. Accordingly, at least half of the total tungsten carbide (vol %) is preferably Spherical Cast WC/$W_2C$. In some embodiments the Spherical Cast WC/$W_2C$ provides at least 60 percent (vol %) of the total tungsten carbide, optionally at least 70 percent (vol %) of the total tungsten carbide and optionally at least 80 percent (vol %) of the total tungsten carbide.

Embodiments of wear and fracture resistant hardfacing compositions described herein preferably have a relatively high thermal conductivity. This is in stark contrast to conventional wisdom as exemplified by U.S. Pat. No. 6,521,353 to Majagi et al., which teaches that a low thermal conductivity is a preferred property of a hardfacing composition.

As previously described, the thermal conductivity of WC and $W_2C$ are not substantially different, and thus, the selection of tungsten carbide in the form of WC and/or $W_2C$ has a very small, if any, effect on the overall thermal conductivity of the composition. Consequently, the thermal conductivity of the hardfacing composition is primarily driven by the selection of the binder material. Observations of the application of hardfacing to drill bits and analysis of drill bit performance in the field have shown that hardfacing including binder materials with relatively high thermal conductivities experience reduced cracking during the application process, good wear resistance, and greater resistance to thermal stress when used in drilling applications as compared to conventional hardfacing including binder materials with relatively low thermal conductivities. In addition, a high thermal conductivity binder material reduces micro and macro thermal gradients in the hardfacing during application and/or when subjected to thermal loads in service, thereby offering the potential to reduce the propensity for thermal damage.

A comparison of the thermal conductivities of various compounds that may be included in the hardfacing binder material are listed in Table 1 below, the data coming from the Handbook of Refractory Compounds by G. V. Samsonov and I. M. Vinitskii, IFI/PLENUM Data Company, 1980.

TABLE 1

| Phase | Thermal Conductivity W/(m · K) | Thermal Conductivity cal/(cm · sec · ° C.) |
|---|---|---|
| $Cr_4B$ | 10.97 | 0.0262 |
| $Cr_4B$ | 10.89 | 0.026 |
| CrB | 20.10 | 0.048 |
| $Cr_2B_5$ | 18.00 | 0.043 |
| $Fe_2B$ | 30.14 | 0.072 |
| $Co_3B$ | 17.00 | 0.0406 |
| $Co_2B$ | 13.98 | 0.0334 |
| CoB | 17.00 | 0.0406 |
| $Ni_3B$ | 41.87 | 0.1 |
| $Ni_2B$ | 54.85 | 0.131 |

As shown in Table 1 above, cobalt, iron, or chromium based binder materials, which form iron boride, cobalt boride and chromium boride after hardfacing deposition, respectively, have significantly lower thermal conductivities than nickel based binder materials that form nickel boride compounds. Consequently, in many conventional hardfacing compositions that preferred low thermal conductivities, cobalt, iron, chromium, or combinations thereof were often included in the binder material. To the contrary, in embodiments described herein, a binder with a relatively high thermal conductivity is preferred, and thus, the hardfacing composition preferably comprises a nickel based binder material (e.g., nickel-silicon-boron binder material).

The binder material also includes silicon (Si) and boron (B). As used herein, the phrase "binder flux" refers to the boron and silicon in the binder material of the hardfacing composition. During the deposition of the hardfacing composition, part of the silicon in the binder material may gather oxygen to form $SiO_2$ as a slag on the top of the surface of the hardfacing. Silicon in the form of slag on the surface can be removed and is not considered as a part of the hardfacing composition. Although $NiSi_3$ may form during deposition and coexist with $NiB_3$, no $NiSi_3$ phase was observed in the hardfacing compositions described in the examples below.

As previously described, binder materials that include cobalt, iron, or chromium have lower thermal conductivities. Accordingly, in embodiments described herein, the binder material preferably contains less than 1.0 wt % of elements other than nickel, boron and silicon, more preferably contain less than 0.75 wt % of elements other than nickel, boron and silicon, more preferably less than 0.5 wt % of elements other than nickel, boron and silicon, and still more preferably less than 0.25 wt % of elements other than nickel, boron and silicon. In particular, embodiments of hardfacing compositions described herein are preferably completely free or at least substantially free (only trace quantities, if any) of chromium, cobalt or iron.

The quality of hardfacing deposited on an underlying metal substrate can be dependent on the fluidity of the hardfacing material during the application. In general, a good fluidity during deposition results in better bonding between the hardfacing and the substrate, a more even distribution of the hardfacing, and a more uniform hardfacing thickness. A number of samples of hardfacing having various binder compositions and various tungsten carbide loadings were applied to observe the fluidity characteristics. Table 2 shows the results of these tests. Herein, binder material compositions are noted with an "X-a Y-b Z" nomenclature, where "X", "Y", and "Z" represent the elements in the binder material, "a" represents the wt % of element "Y" in the binder material composition, and "b" represents the wt % of element "Z" in the binder material composition. Element "X" does not include a wt % as it represents the balance of the binder material composition. For example, the hardfacing composition of Sample 1 shown below comprises 70 wt % WC/$W_2C$ and 30 wt % binder material. The binder material of Sample 1 includes nickel, silicon, and boron, with the silicon content of the binder material being 3.39 wt %, the boron content of the binder material being 1.78 wt %, and nickel being the balance of the binder material.

TABLE 2

| Sample | $WC/W_2C$ Content of Hardfacing Composition (wt %) | Binder Material Content of Hardfacing Composition (wt %) | Binder Material Composition (wt %) | $WC/W_2C$ Shape | Binder Flux (Si + B) Content (wt %) | Fluidity |
|---|---|---|---|---|---|---|
| 1 | 70 | 30 | Ni-3.39 Si-1.78 B | spherical | 5.17 | poor |
| 2 | 75 | 25 | Ni-4.56 Si-3.27 B | spherical | 7.83 | good |
| 3 | 80 | 20 | Ni-4.56 Si-3.27 B | spherical | 7.83 | good |
| 4 | 70 | 30 | Ni-3.98 Si-2.53 B | spherical | 6.51 | good |
| 5 | 70 | 30 | Ni-1.0 Cr-3.3 Si-1.6 B-0.75 Fe | spherical | 4.90 | poor |
| 6 | 70 | 30 | Ni-3.39 Si-1.78 B | angular | 5.17 | poor |
| 7 | 55 | 45 | Ni-3.51 Si-1.93 B | spherical | 5.44 | good |
| 8 | 58 | 42 | Ni-3.51 Si-1.93 B | spherical | 5.44 | good |
| 9 | 70 | 30 | Ni-4.56 Si-3.27 B | spherical | 7.83 | good |
| 10 | 65 | 35 | Ni-4.56 Si-3.27 B | spherical | 7.83 | good |
| 11 | 65 | 35 | Ni-3.98 Si-2.53 B | spherical | 6.51 | good |
| 12 | 60 | 40 | Ni-3.98 Si-2.53 B | spherical | 6.51 | good |
| 13 | 60 | 40 | Ni-3.39 Si-1.78 B | spherical | 5.17 | poor |
| 14 | 60 | 40 | Ni-3.51 Si-1.93 B | spherical | 5.44 | poor |
| 15 | 68 | 32 | Ni-9.5 Cr-3 Fe-3 Si-1.6 B-0.3 C | spherical | 4.8 | poor |
| 16 | 60 | 40 | Ni-9.5 Cr-3 Fe-3 Si-1.6 B-0.3 C | spherical | 4.8 | poor |

As shown in Table 2, samples having a greater binder flux (silicon plus boron) content (wt %) in the binder material exhibited better fluidity than comparable compositions having a lower binder flux (silicon plus boron) content (wt %) in the binder material. Both Samples 4 and 5 had hardfacing compositions of 70 wt % tungsten carbide and 30 wt % of a nickel based binder material. Sample 4 had a non-Ni binder material content of 6.51 wt % made up exclusively of Si and B, and exhibited good fluidity properties. Sample 5 had a non-Ni binder material content of 6.65 wt %, of which 1.0 wt % was Cr, 0.75 wt % was Fe, and 4.90 wt % was binder flux (Si and B), and exhibited poor fluidity properties. The 1.75 wt Cr and Fe content in binder material of Sample 5 changed the binder material characteristic from one of good fluidity to one of poor fluidity. For this reason, as well as the impact on thermal conductivity described above, in embodiments of hardfacing compositions described herein, the binder material preferably contains less than 1.0 wt % of elements other than nickel, boron and silicon; more preferably contain less than 0.75 wt % of elements other than nickel, boron and silicon; more preferably less than 0.5 wt % of elements other than nickel, boron and silicon; and still more preferably less than 0.25 wt % of elements other than nickel, boron and silicon. In particular, embodiments of hardfacing compositions described herein are preferably completely free or at least substantially free (only trace quantities, if any) of chromium, cobalt or iron.

Samples 1 and 6 are identical other than Sample 1 is composed of spherical tungsten carbide while Sample 6 is composed of angular (non-spherical) tungsten carbide. Both Samples 1 and 6 exhibited poor fluidity.

Samples 15 and 16 were commercially available hardmetal compositions and are available from Technogenia S.A. under the names Technosphere® GG and LaserCarb®. Both samples 15 and 16 exhibited poor deposition fluidity.

Figure 7:
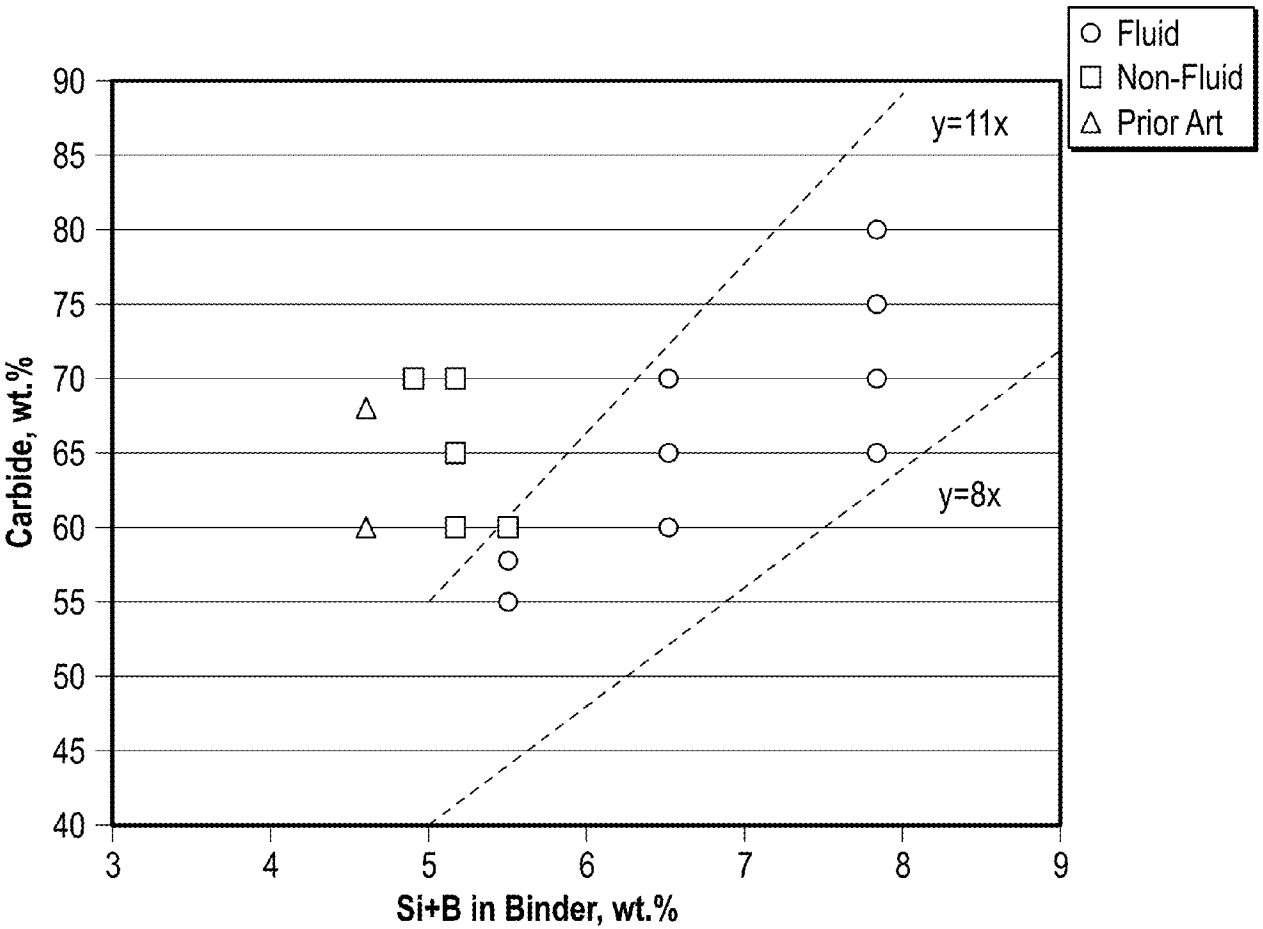
FIG. 7 is a graph illustrating the carbide content versus the binder flux content for various hardfacing compositions.

FIG. 7 is a graph of the data from Table 2 illustrating the effect of the content of the binder flux (boron and silicon) (wt %) in the binder material and the content of the carbide (wt %) in the hardfacing composition on the deposition fluidity. In general, as the binder flux content in the binder material increases, the carbide (hardphase) content in the hardfacing composition can be increased while maintaining good fluidity. For example, carbide contents of 65 wt % and 70 wt % in the hardfacing composition are achieved while maintaining good deposition fluidity at a binder flux content above 6 wt % in the binder material. At binder flux content above 7 wt % in the binder material, good deposition fluidity is maintained with carbide contents of greater than 70 wt % in the hardfacing composition.

As shown in FIG. 7, good deposition fluidity was observed for hardfacing compositions having a carbide content (wt %) in the hardfacing composition up to eleven times the binder flux content (wt %) in the binder material. The upper dashed line on the graph in FIG. 7 indicates a ratio of 11:1 of the carbide content (wt %) in the hardfacing composition to the binder flux content (wt %) in the binder material; and the lower dashed line on the graph in FIG. 7 indicates a ratio of 8:1 of the carbide content (wt %) in the hardfacing composition to the binder flux content (wt %) in the binder material. Good fluid depositions were observed in hardfacing composition samples having carbide content (wt %) in the hardfacing composition to the binder flux content (wt %) in the binder material ratios between 8:1 and 11:1 (i.e., between the dashed lines on FIG. 7). Thus, embodiments of hardfacing compositions described herein, the carbide content (wt %) in the hardfacing composition is preferably between eight to eleven times the binder flux content (wt %) in the binder material, and more preferably between nine to eleven times the binder flux content (wt %) in the binder material.

Samples 15 and 16, the commercially available hardfacing compositions, are designated by triangles in FIG. 7. Both Samples 15 and 16 have a ration of carbide content (wt %) in the hardfacing composition to the binder flux content (wt %) in the binder material greater than 11:1 (i.e., above the upper dashed line on FIG. 7), and thus, are located in the poor deposition fluidity region of FIG. 7.

A binder material having a relatively high thermal conductivity and good deposition fluidity has been found to reduce the propensity for undesirable thermal stress cracking in the hardfacing material layer in the application process as well as during use. Improvements in deposition fluidity also enable a thicker layer of the hardfacing material to be applied to the underlying substrate, thereby providing added wear resistance and extending the life of the associated hardware.

Due to the improved thermal properties, tests of hardfacing compositions described herein have been air cooled without cracking, and without the use of insulation to manage post-deposition cooling rates. Many conventional hardfacing compositions require the use of insulation during the cooling process to reduce hardfacing cracking and spalling.

Hardware (e.g., bearings), downhole tools and equipment (e.g., stabilizers, collars, etc.), drill bits (e.g., fixed cutter bits, roller cone bits, percussion bits, etc.), and other devices having wear and fracture resistant surfaces formed from the hardfacing compositions and/or binder materials described herein offer the potential for a more consistent hardfacing microstructure with a reduction of the detrimental effects of thermal applications (e.g., the introduction of unwanted thermal stress-related cracks into the material microstructure) as compared to conventional hardfacing compositions. In addition, they can provide a surface layer or surface feature with enhanced resistance to wear, thermal stress and material loss, as well as an ability to achieve a reproducible and dimensionally consistent hardfacing layer thickness. As a result, embodiments of hardfacing compositions described herein offer the potential to enhance the service life of the underlying hardware (e.g., bearing, drill bit, etc.).

Two samples of a hardmetal composition according to the principles described herein, Samples A and B, and two conventional commercially available hardfacing compositions, Samples D and E, were tested for low stress abrasion resistance according to the ASTM G65 standards and high stress abrasion resistance according to the ASTM B611 standards. Sample A had a composition of 70 wt % $WC/W_2C$ and 30 wt % binder material (Ni-4.56 Si-3.27 B), and Sample B had a composition of 55 wt % $WC/W_2C$ and 45 wt % binder material (Ni-3.39 Si-1.78 B). Sample D is a conventional hardfacing having a composition of 55 wt % angular $WC/W_2C$ and a 45 wt % binder material (Ni-7.5Cr-3Fe-3.5Si-1.5B-0.3C) commercial available as Eutectic 8913 from Eutectic Corporation of Menomonee Falls, Wis., and Sample E is a conventional hardfacing having 68 wt % spherical $WC/W_2C$ and a 32 wt % binder (Ni-9.5 Cr-3 Fe-3 Si-1.6 B-0.6 C) commercially available as Technosphere GG from Technogenia S.A. of Conroe, Tex. In addition, a material composition used to make the matrix bodies of drill bits, Sample C, was also tested according to the ASTM G65 testing standards and ASTM B611 standards, and used as a comparative sample. Sample C was a tungsten carbide matrix body bit material manufactured by infiltrating tungsten carbide particles, macrocrystalline WC or chill-cast and crushed $WC/W_2C$, or a mixture thereof, with a Cu—Ni—Mn—Zn alloy, comprising a 66 vol % WC content in a Cu based alloy (Cu-15 Ni-24 Mn-8 Zn). The material of Sample C is commercially available from Kennametal, Inc. of Latrobe, Pa.

Figure 8:
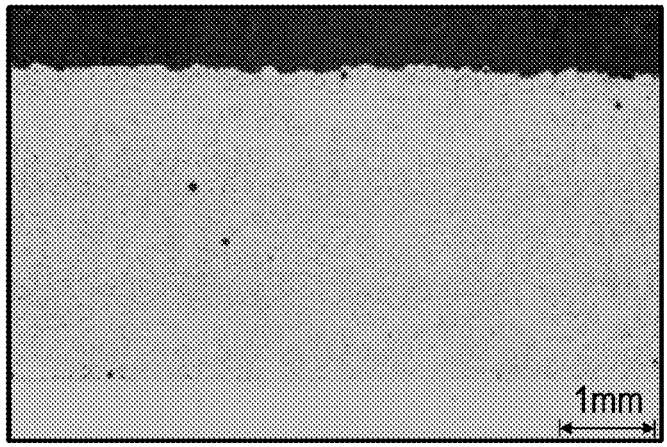
FIG. 8 illustrates enlarged images of the microstructure of embodiments of hardfacing compositions in accordance with the principles described herein.
Figure 8:
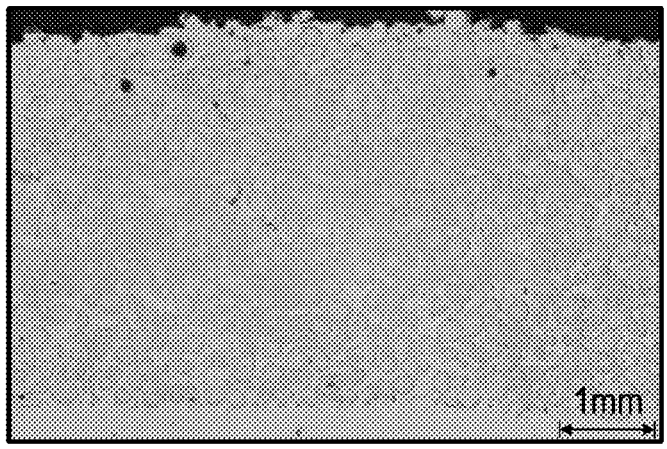
Figure 8:
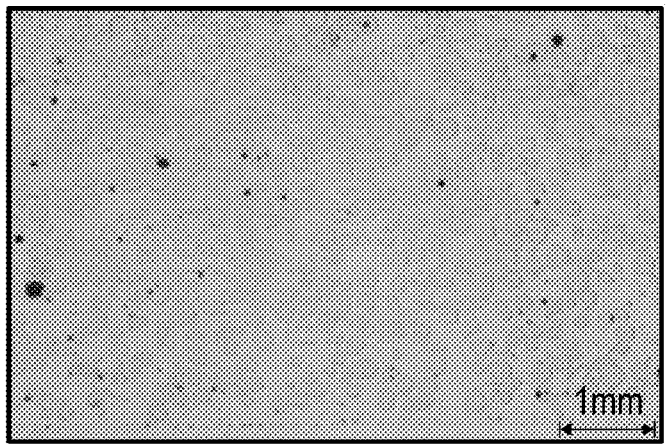
Figure 9:
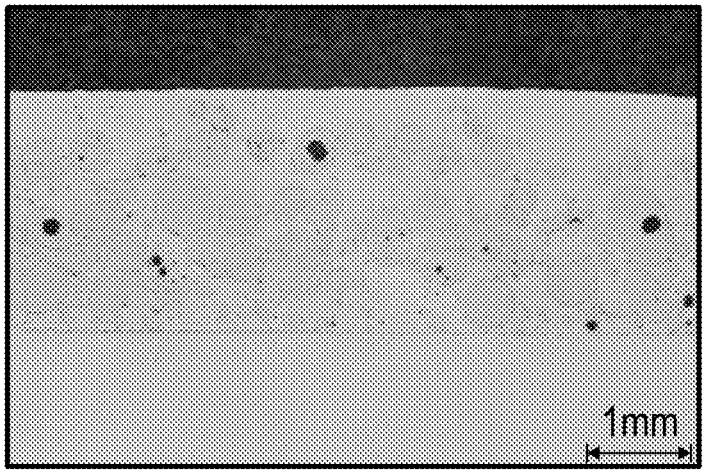
FIG. 9 illustrates enlarged images of the microstructure of prior art hardfacing compositions in accordance with the principles described herein.
Figure 9:
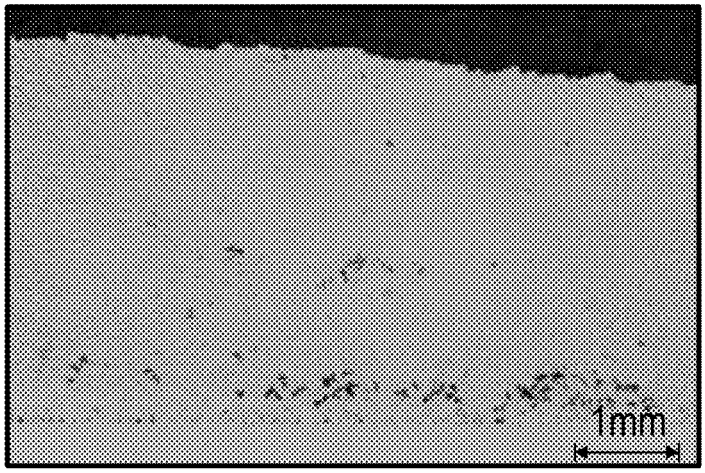

Microstructure images of embodiments described herein applied by various thermal spray techniques are shown in FIG. 8, and illustrate a crack-free and relatively dense structure with uniform distribution of spherical $WC/W_2C$ particles throughout the hardfacing layer thickness. In particular, the upper image shown in FIG. 8 is the microstructure of Sample A in Table 3 and the lower image shown in FIG. 8 is the microstructure of Sample B in Table 3. Microstructure images of comparative Samples D and E are shown in FIG. 9, and illustrate pores and micro-cracks throughout the hardfacing layer thickness.

The test results indicated that Sample A applied via flame spray application process resulted in better abrasion resistance as compared to the commercially available hardfacing compositions (Samples D and E), while Sample B applied via laser cladding application process, and containing lower content of $WC/W_2C$ than Sample A, had an abrasion resistance comparable to Samples D and E. The abrasion resistance test data are shown in Table 3 below.

TABLE 3

| Sample | Low Stress Abrasion ASTM G65 ($mm^3$/1000 revolutions) | High Stress Abrasion ASTM B611 ($mm^3$/1000 revolutions) |
|---|---|---|
| A (flame spray) | 0.78 | 0.36 |
| B (laser clad) | 1.50 | 0.52 |
| C (comparative matrix bit material) | 1.67 | 1.23 |
| D (conventional hardfacing) | 3.38 | 0.75 |
| E (conventional hardfacing) | 1.33 | 0.42 |

In general, the lower the volume of material removed/lost by abrasive wear ($mm^3$/1000 revolutions), the better the abrasion wear resistance per low-stress and high-stress abrasion test. As shown in Table 3, Sample A had a low stress abrasion of 0.78 $mm^3$/1000 revolutions and a high stress abrasion of 0.36 $mm^3$/1000 revolutions, and Sample B had a low stress abrasion of 1.50 $mm^3$/1000 revolutions and a high stress abrasion of 0.52 $mm^3$/1000 revolutions. Thus, Samples A and B each had a low stress abrasion of less than or equal to 1.50 $mm^3$/1000 revolutions, and a high stress abrasion less than or equal to 0.52 $mm^3$/1000 revolutions. For embodiments of hardfacing compositions described herein, the low stress abrasion is preferably equal to or less than 2.0 $mm^3$/1000 revolutions, more preferably equal to or less than 1.7 $mm^3$/1000 revolutions, more preferably equal to or less than 1.5 $mm^3$/1000 revolutions, more preferably equal to or less than 1.3 $mm^3$/1000 revolutions, and still more preferably equal to or less than 1.0 $mm^3$/1000 revolutions or less. Further, for embodiments of hardfacing compositions described herein, the high stress abrasion is preferably equal to or less than 1.0 $mm^3$/1000 revolutions, more preferably equal to or less than 0.75 $mm^3$/1000 revolutions, more preferably equal to or less than 0.6 $mm^3$/1000 revolutions, and still more preferably equal to or less than 0.5 $mm^3$/1000 revolutions.

FIGS. 2-4, 5, and 6 previously described illustrate exemplary devices to which embodiments of hardfacing compositions described herein can be applied to enhance wear resistance, reduce thermal stress induced cracking, and generally enhance service durability. However, it should be appreciated that embodiments of hardfacing compositions described herein may also be applied to a multitude of other devices for which wear resistant hardfacing is beneficial such as drilling equipment (e.g., reamers, under-reamers, V-stabs, centralizers, and the like), drill collars, percussion drill bits, and bearings (e.g., radial bearings, needle bearings, thrust bearings, ball bearings, roller bearings, etc.) Moreover, although FIGS. 2-4, 5, and 6 disclose the application of hardfacing compositions on outer surfaces of exemplary devices, embodiments of hardfacing described herein may also be applied to radially inner surfaces.

Figure 10:
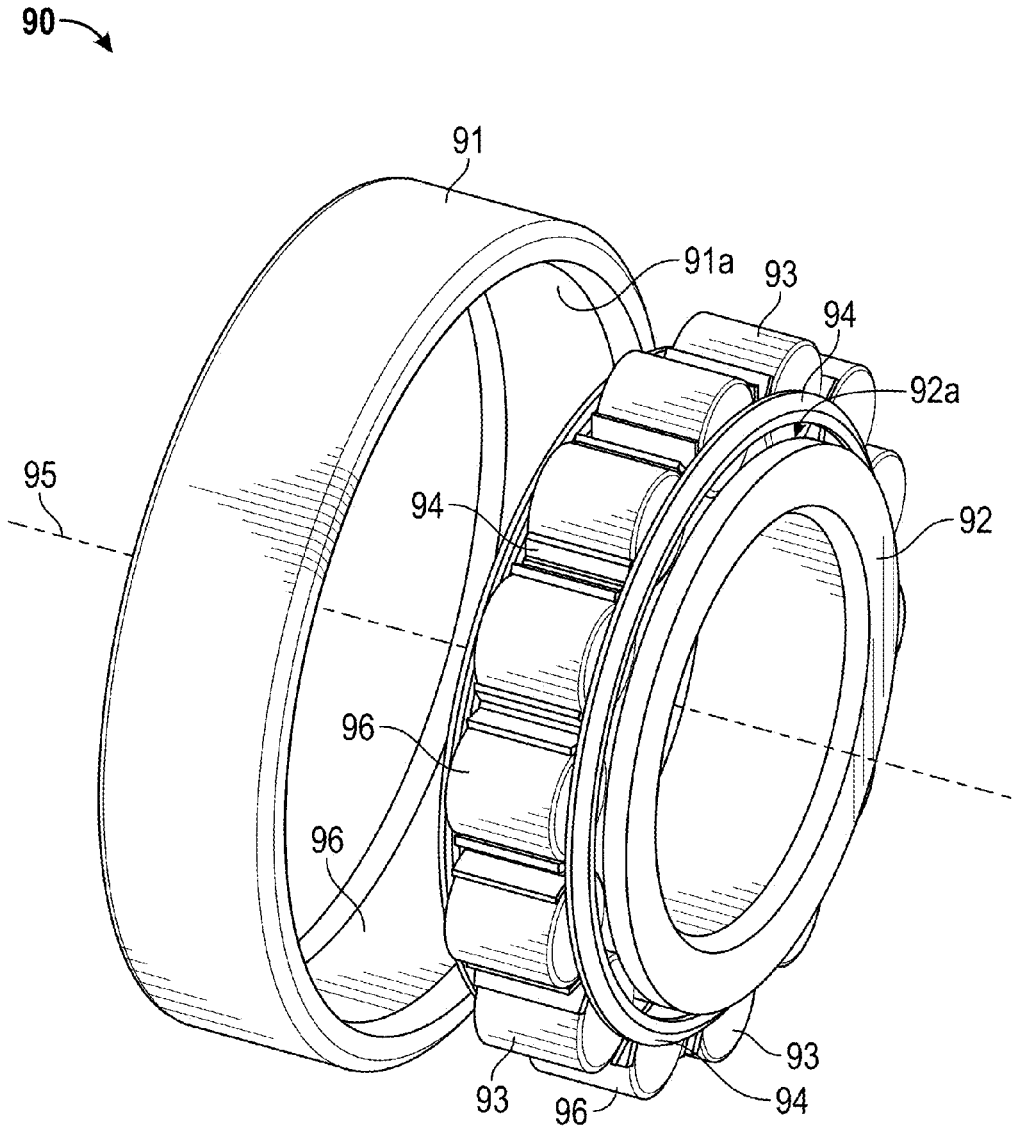
FIG. 10 is an exploded view of an embodiment of a radial bearing including hardfacing in accordance with the principles described herein.

Referring now to FIG. 10, a radial bearing 90 for supporting radial loads while allowing relative rotation between two components is shown. Radial bearing 90 is a roller bearing having a central axis 95 and including an outer race 91, an inner race 92 disposed within outer race 91, and a plurality of circumferentially spaced roller elements 93 radially positioned between races 91, 92. Race 91 is a ring including an annular recess or groove 91*a* on its inner surface, and race 92 is a ring including an annular recess or groove 92*a* on its outer surface. Roller elements 93 are seated in recesses 91*a*, 92*a*, which restrict roller elements 93 from moving axially relative to races 91, 92. A cage 94 is provided between races 91, 92 to maintain the circumferential spacing of roller elements 93.

In operation, races 91, 92 rotate about axis 95 relative to each other, and roller elements 93 roll in recesses 91*a*, 92*a*. Roller elements 93 support radial loads while allowing races 91, 92 to roll with very little rolling resistance and sliding. Contact between races 91, 92 and roller elements 93 under radial load over time can wear and/or dent races 91, 92 and roller elements 93, as well as increase the temperature of races 91, 92 and roller elements 93. Thus, to enhance resistance to wear and thermal stresses, hardfacing 96 in accordance with the principles described herein is applied to races 91, 92 in grooves 91*a*, 92*a*, respectively, and applied to the outer surfaces of roller elements 93. Although radial bearing 90 is a cylindrical roller bearing, hardfacing 96 may also be applied to contact surfaces between races and roller elements in other types of bearings such as radial ball bearings, thrust bearings, tapered roller bearings, etc.

Cracks in hardfacing employed on radial bearings are particularly detrimental due to the relatively high heat generated along the contact surfaces of radial bearings. In particular, spalling, delamination, and separation of the hardfacing from the underlying substrate due to thermal stresses typically initiates at original crack sites, and can lead to catastrophic failure.

Figure 11:
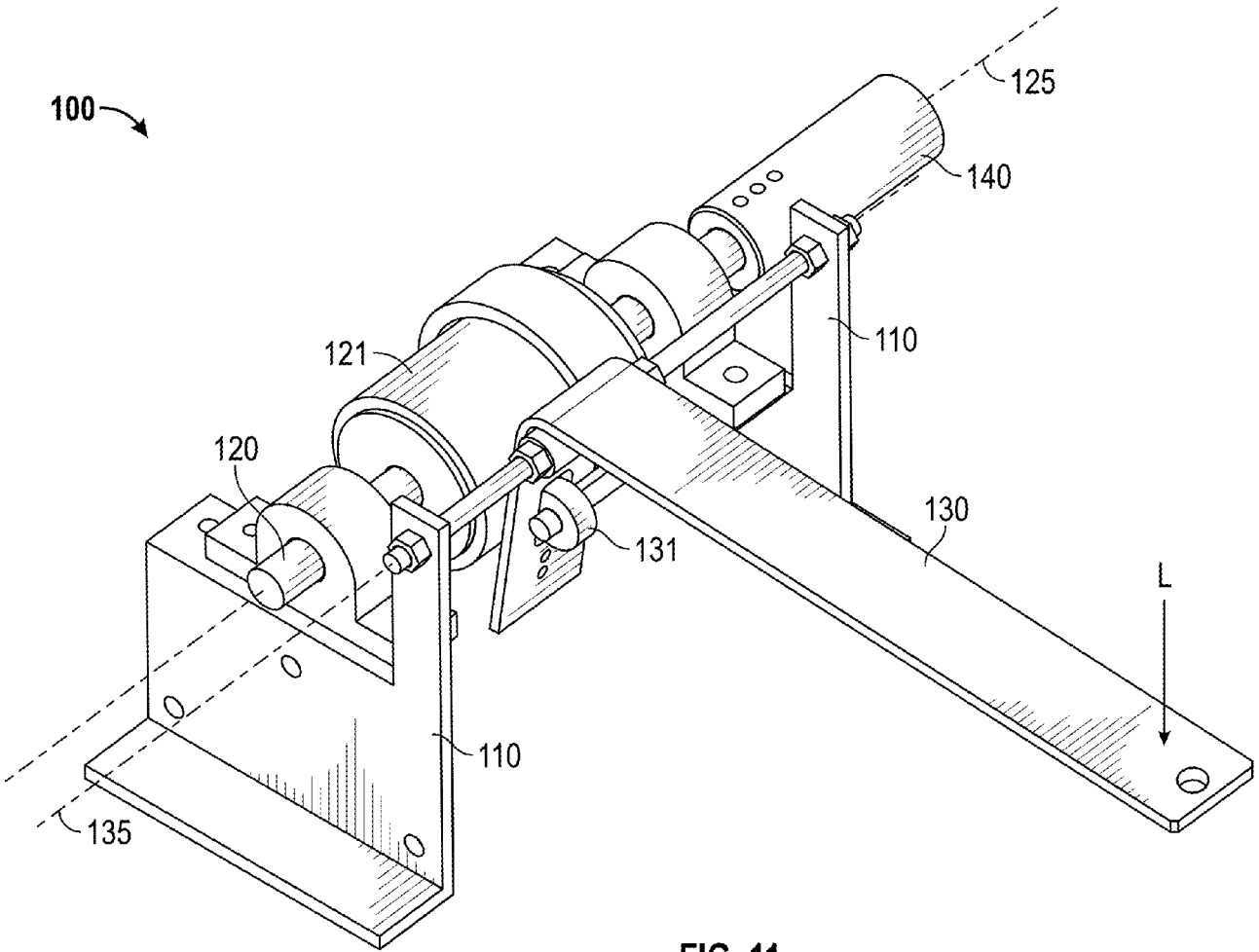
FIG. 11 is a perspective view of an apparatus for testing hardfacing compositions subjected to radial loads along rolling contacts.

A variety of hardfacing compositions were tested for use with radial bearings such as radial bearing 90 previously described. FIG. 11 shows the testing apparatus 100 used to test the hardfacing compositions. Apparatus 100 includes a stand 110, a shaft 120 rotatably coupled to the stand, a bearing wheel 121 mounted to shaft 120, a lever arm 130 pivotally coupled to stand 110, and a wear wheel 131 rotatably coupled to lever arm 130. Bearing wheel 121 is coaxially aligned with and fixably attached to shaft 120, and thus, wheel 121 and shaft 120 rotate about the central axis 125 of shaft 120. Rotation of shaft 120, and hence wheel 121, is driven by a motor 140. Lever arm 130 pivots relative to stand 110 about an axis 135 oriented parallel to axis 125, and wear wheel 131 rotates relative to lever arm 130 about an axis parallel to axes 125, 135. By applying a load L to the end of lever arm 130 distal axis 135 and wheel 131, wear wheel 131 is pressed into rolling engagement with bearing wheel 121. By varying load L, the compressive forces between wheels 121, 131 can be controlled and varied.

Three different samples of hardfacing compositions were tested using apparatus 100. For testing, a plurality of bearing wheels 121 and wear wheels 131 were machined from AISI 4130 steel. Each wear wheel 131 had a diameter of 38 mm and an axial length of 12.7 mm, and each bearing wheel 121 had a diameter of 105 mm and an axial length of 95 mm. The different hardfacing compositions to be tested were then applied to the radially outer surfaces contact surfaces of wheels 121, 131 by laser cladding or plasma transferred arc welding (PTAW). One hardfacing composition was tested in each test. Further, for each given test, the same hardfacing composition was applied to both wheels 121, 131. To test the applied hardfacing compositions in a radially compressive rolling environment as would be experienced in a radial bearing, a downward load L of 80 lbf. was applied to lever arm 130 to press wheel 131 into wheel 121, and wheels 121, 131 were rotated at 60 RPM and 150 RPM, respectively. After 480 minutes of continuous rolling contact under load L, wheels 121, 131 were removed from apparatus 100 and analyzed. In particular, the radial depth of wear in each wheel 121, 131 was calculated by comparing the measured outer diameter of each wheel 121, 131 before testing and the measured outer diameter of each wheel 121, 131 along the wear track after testing. The radial bearing wear simulation test data are shown in Table 4 below.

TABLE 4

| Sample | Hardfacing Application Process | $WC/W_2C$ Content of Hardfacing Composition (wt %) | Binder Material Content of Hardfacing Composition (wt %) | Binder Material Composition (wt %) | Radial Depth of Wear in Bearing Wheel (mm) | Radial Depth of Wear in Wear Wheel (mm) |
|---|---|---|---|---|---|---|
| A' | Laser cladding | 60 | 40 | Ni-4.0 Si-2.5 B | 0.28 | 0.20 |
| B' | Laser cladding | 60 | 40 | Ni-3.1 Si-1.7 B-9.5 Cr-3 Fe-0.3 C | 0.51 | 0.66 |
| C' | PTAW | 65 | 35 | Ni-3.8 Si-3.3 B-16.5 Cr-0.8-1.0 W-0.8 to 1.0 C | 0.36 | 1.55 |

The type of $WC/W_2C$ employed in each sample tested was the 80-210 μm diameter spherical $WC/W_2C$ particles manufactured by Technogenia S.A. of Conroe, Tex. Thus, the primary difference between the samples was the composition of the binder material, and more specifically, the alloying elements in the Ni-alloy. Sample A' was a hardfacing composition in accordance with the principles described herein, including only nickel, silicon, and boron in the binder material, whereas Samples B' and C' were conventional hardfacing compositions having a binder material that included iron and/or chromium.

As shown in Table 4, Sample A' provided greater wear resistance on both the bearing wheel and the wear wheel than Samples B' and C'. Without being limited by this or any particular theory, it is believed that the performance differences between the three hardfacing compositions was primarily due to differences in the thermal conductivity of the binder materials. The primary phase in the binder material of Sample A' was $Ni_3B$, whereas the primary phase in the binder material in Samples B' and C' was CrB.

To assess the impact of the addition of chromium, iron, aluminum, or combinations thereof in the binder material on hardfacing thermal conductivity, four cylinders were fabricated by Spark Plasma Sintering (SPS). Each cylinder had a composition identical to powdered mixtures of hardfacing. In particular, to form each cylinder, a premix of 60 wt %, 80-210 μm diameter spherical $WC/W_2C$ particles and 40 wt % Ni-alloy powder were placed in a graphite sleeve and then positioned between two graphite plungers in a vacuum chamber. A different Ni-alloy composition was used for each of the four cylinders, as shown in Table 5 below. The chamber was then evacuated to ~7 Pa, electrical power was supplied through the graphite sleeve to heat the powered mixture, and uniaxial force was gradually increased on one of the plungers. Sintering was carried out under a uniaxial force of 59 MPa in a vacuum of 20 Pa at 1213K. At least 99.9% theoretical density was achieved in each sintered material. Disk-shaped samples having a diameter of 12.7 mm and axial length of 2 mm were machined from the SPS sintered cylinders, and then subjected to thermal diffusivity and specific heat measurements at 300K and 810K using a Holometrix Thermalflash 2200 instrument available from Holometrix Inc, of Cambridge, Mass. according to STM E1461-92 "Standard Test Method for Thermal Diffusivity of Solids by the Flash Method." Using the thermal diffusivity and specific heat measurements, the thermal conductivity was calculated according to the following equation:

$$\kappa = D \cdot Cp \cdot \rho$$

where κ is the thermal conductivity, D is the measured diffusivity, Cp is the measured specific heat, and ρis the density of the test material.

TABLE 5

| Sample | $WC/W_2C$ Content of Hardfacing Material (wt %) | Binder Material Content of Hardfacing Material (wt %) | Thermal Conductivity (300K) | Thermal Conductivity (810K) |
|---|---|---|---|---|
| A" | 60 | 40 (Ni-4.0 Si-2.5 B) | 26.2 | 32.1 |
| B" | 60 | 40 (Ni-3.5 Si-1.9 B) | 24.9 | 31.3 |
| C" | 60 | 40 (Ni-3.5 Si-1.9 B-0.75 Al) | 22.5 | 29.1 |
| D" | 60 | 40 (Ni-4.5 Si-3.1 B-7 Cr-2 Fe) | 16.2 | 23.8 |

As shown in Table 5, Sample A" had the same composition as Sample A' previously described. In addition, Samples A" and B", each had a binder material consisting exclusively of nickel, silicon, and boron. Sample C" was the same to Sample B" with the exception that Sample C" included small quantities of aluminum in the binder material. Sample D" had a conventional hardfacing composition including chromium and iron. Samples A" and B" exhibited a significantly higher thermal conductivity at 300K and 810K than the Sample D". Since Sample C' had the same composition as Sample B' with the sole exception that aluminum was added to the binder material, Sample C' provided insight as to the detrimental effect of an elemental addition to the binder material on thermal conductivity. In particular, a 0.75 wt % addition of aluminum in the Ni, 3.5 Si, 1.9 B binder material degraded thermal conductivity by 9.6% and 7% at 300K and 810K, respectively. Further, as shown by the Sample D", additions of chromium and iron in the binder material drastically reduced thermal conductivity, thereby confirming that a hardfacing composition having a binder material comprising chromium and iron lowers its thermal conductivity.

Embodiments of hardfacing compositions described herein preferably have a thermal conductivity greater than 22.0 W/(m·K) or 0.053 cal/(cm·sec·° C.) at 300K, and more preferably a thermal conductivity of greater than 25.0 W/(m·K) or 0.060 cal/(cm·sec·° C.). To achieve the relatively high thermal conductivity, as well as good deposition fluidity discussed above, the binder material preferably comprises 0.5 to 10 wt % silicon and 0.5 to 14 wt % boron, with the balance of the binder material being nickel.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. A hardmetal composition, comprising:

tungsten carbide in an amount greater than 50 weight percent of the hardmetal composition; and a binder material consisting of nickel and a binder flux;

wherein the binder flux comprises; boron and silicon;

wherein the silicon in the binder flux is 0.5 to 10 weight percent of the binder material and the boron in the binder flux is 0.5 to 14 weight percent of the binder material;

wherein the binder flux is free of cobalt, chromium, and iron;

wherein the tungsten carbide content (wt %) in the hardmetal composition is eight to eleven times the binder flux content (wt %) of the binder material.

2. The hardmetal composition of claim 1, wherein the tungsten carbide comprises spherical cast tungsten carbide, cast and crushed tungsten carbide, or macro-crystalline tungsten carbide.

3. The hardmetal composition of claim 2, wherein the tungsten carbide comprises at least 50 volume percent of spherical tungsten carbide particles.

4. The hardmetal composition of claim 1, wherein the tungsten carbide is between 50 to 90 weight percent of the hardmetal composition.

5. The hardmetal composition of claim 1, wherein the binder flux consists of silicon and boron.

6. The hardmetal composition of claim 1 applied to an underlying metal via a thermal spray technique.

7. The hardmetal composition of claim 6, wherein the thermal spray technique is chosen from the group of laser cladding, plasma transferred arc, and flame spray.

8. The hardmetal composition of claim 1, wherein the binder material has a thermal conductivity of greater than 22.0 Watt/m·K at 300K.

9. The hardmetal composition of claim 8, wherein the binder material has a thermal conductivity of greater than 25.0 Watt/m·K at 300K.

10. The hardmetal composition of claim 1, applied by a thermal spray technique to an apparatus chosen from the group consisting of drill bit, rotary cone bit, drag bit, mill tooth bit, reamer, under-reamer, stabilizer, centralizer, and a radial bearing.

11. The hardmetal composition of claim 1, wherein the hardmetal has a low stress abrasion of less than 2.0 $mm^3$/1000 revolution and a high stress abrasion of less than 1.0 $mm^3$/1000 revolution.

12. The hardmetal composition of claim 11, wherein the hardmetal has a low stress abrasion of less than 1.3 $mm^3$/1000 revolution and a high stress abrasion of less than 0.50 $mm^3$/1000 revolution.

13. A bit for drilling a borehole in earthen formations, comprising:

a bit body;

a hardfacing composition applied to the bit body;

wherein the hardfacing composition comprises tungsten carbide in an amount greater than 50 weight percent of the hardfacing composition;

wherein the hardfacing composition further comprises a binder material consisting of nickel and a binder flux comprising boron and silicon;

wherein the silicon in the binder flux is 0.5 to 10 weight percent of the binder material and the boron in the binder flux is 0.5 to 14 weight percent of the binder material;

wherein the binder flux is free of cobalt, chromium, and iron;

wherein the tungsten carbide content (wt %) in the hardmetal composition is eight to eleven tunes the binder flux content (wt %) of the binder.

14. The bit of claim 13, wherein the tungsten carbide comprises at least 50 volume percent of spherical tungsten carbide particles.

15. The bit of claim 13, wherein the drill bit is a rotary cone bit or a drag bit.

16. The bit of claim 13, wherein the hardmetal has a low stress abrasion of less than 2.0 $mm^3$/1000 revolution and a high stress abrasion of less than 1.0 $mm^3$/1000 revolution.

17. The bit of claim 13 wherein the hardmetal is applied to the bit body via a thermal spray technique chosen from the group of laser cladding, plasma transferred arc, and flame spray.

18. The bit of claim 13, wherein the hardmetal binder material has a thermal conductivity of greater than 22.0 Watt/m·K at 300K.

19. A method for providing a wear resistant hardfacing composition onto an apparatus comprising:

providing a hardfacing composition consisting of tungsten carbide in an amount greater than 50 weight percent of the hardfacing composition and a binder material consisting of at least 90 weight percent nickel and a binder flux of between 3.5 to 10.0 weight percent chosen from the group consisting of boron and silicon, wherein the binder flux is free of cobalt, chromium, and iron, and wherein the tungsten carbide content (wt %) in the hardmetal composition is eight to eleven times the binder flux content (wt %) of the binder;

depositing the hardfacing composition onto one or more portions of the apparatus.

20. The method of claim 19, wherein the tungsten carbide is at least 50 volume percent of spherical tungsten carbide particles.

21. The method of claim 19, wherein the tungsten carbide is present in an amount between 55 to 80 weight percent.

22. The method of claim 19, wherein the binder material consists of nickel and the binder flux.

23. The method of claim 19, wherein the hardfacing composition is deposited on the apparatus with a thermal spray technique chosen from the group of laser cladding, plasma transferred arc, and flame spray.

24. A hardmetal composition comprising:

tungsten carbide in an amount greater than 60 weight percent of the hardmetal composition, the tungsten carbide comprising at least 50 volume percent of spherical tungsten carbide particles;

a binder material consisting of nickel and a binder flux consisting of silicon and boron, wherein the silicon in the binder flux is 0.5 to 10 weight percent of the binder material and the boron in the binder flux is 0.5 to 14 weight percent of the binder material;

wherein the tungsten carbide content (wt %) in the hardmetal composition ranges from eight to eleven times the binder flux content (wt %) of the binder.

* * * * *